United States Patent [19]

Fillmann et al.

[11] 3,932,981

[45] Jan. 20, 1976

[54] MACHINE FOR MULTIPLE ARTICLE PACKAGING

[75] Inventors: Walter Fillmann; Werner Kalmbach, both of Stuttgart, Germany

[73] Assignee: Fr. Hesser Maschinenfabrik AG, Stuttgart - Bad Cannstatt, Germany

[22] Filed: Oct. 7, 1974

[21] Appl. No.: 512,502

[30] Foreign Application Priority Data

July 19, 1974 Germany ..... 2434805

[52] U.S. Cl. ..... 53/124 D; 53/230; 100/291

[51] Int. Cl.[2] ..... B65B 63/02

[58] Field of Search ..... 53/124 D, 230; 100/291

[56] References Cited

UNITED STATES PATENTS

| | | | |
|---|---|---|---|
| 1,925,365 | 9/1933 | Berg | 100/291 X |
| 3,507,089 | 4/1970 | Mizelle et al. | 53/230 X |

*Primary Examiner*—Travis S. McGehee

*Attorney, Agent, or Firm*—Edward E. Sachs

[57] ABSTRACT

A wrapping machine having a lifting table for presenting articles to the folding channel. Pressure plates are mechanically coupled to the vertical motion of the lifting table. As the table is elevated, cam surfaces on the machine act to bring the plates toward one another in order to compress articles which were previously deposited on the table.

8 Claims, 3 Drawing Figures

MACHINE FOR MULTIPLE ARTICLE PACKAGING

This invention relates to packaging machines and more particularly to machines for wrapping a plurality of articles in a common package.

Machines of the general type contemplated in this invention are described, for example, in co-pending patent application Ser. No. 501,223 filed Aug. 28, 1974. Such machines may comprise a horizontally extending folding channel having stationary folding means arranged around the path of the articles or objects to be packaged. A sliding ram is used to push the articles along the folding channel. At the entrance end of the channel, a device is mounted for supplying packaging-material blanks in a vertical plane. At the remote end of the channel, four folding plates are mounted for movement substantially at right angles to the channel.

During a typical operating cycle a packaging-material blank is fed into vertical position across the channel. The ram then pushes the articles against the blank and along the folding channel, causing the blank to envelop the articles in a U-shape around the top, front, and bottom portions. As the articles advance past the stationary folding means, the extending sides of the packaging-material are folded against the sides of the articles which are substantially parallel to the path of the ram. When the articles are pushed beyond the folding channel, the sliding ram retreats to its initial position.

In the cited pending application, a lifting table is used at the entrance of the folding channel. This table receives the articles on a first level and raises them to the level of the folding channel and into the path of the delivery ram. Where separate articles are to be wrapped side-by-side, it is difficult to maintain them set in the desired compact unit to insure ultimate production of a firm inherently stiff final package.

U.S. Pat. No. 3,383,825 discloses a machine for wrapping a plurality of objects, wherein the problem of establishing a firm set is solved by the use of pressure plates. These pressure plates are positioned on opposite sides of the feed slide and move transversely under the control of hydraulic or pneumatic cylinders. This highly complex solution, becomes even more unsatisfactory when one attempts to adopt it to machines having lifting tables.

An object of the invention is to provide an improved wrapping machine having a lifting table with means for handling a plurality of articles.

Another object of the invention is to provide an improved wrapping machine including relatively simple means operative to secure a set of said articles, prior to wrapping.

Another object of the invention is to provide an improved wrapping machine having a lifting table and pressure elements mechanically coupled to move transversely in response to elevation of the table.

In accordance with the invention, a machine is provided for wrapping a plurality of articles in a single package. The machine comprises elevator means for delivering a plurality of articles to a particular level, means operative to transversely compress the plurality of articles as a function of the height of the elevator means, and means for horizontally feeding and wrapping the articles after delivery to the particular level.

In a particular wrapping machine embodying the invention, pressure elements are mounted on a lifting table and arranged to move orthogonally of the folding channel in response to elevation of the table. The pressure element movement is effected by mechanically coupled members consisting of guide rails having contoured cam surfaces mounted on the frame of the machine and cam follower rollers mounted on the pressure plates. Thus, the same drive that is used to elevate the lifting table, indirectly serves to drive the pressure plates.

The illustrative embodiment of the invention is further characterized in that the pressure units are arranged as separate elements, one above the other. These elements may be spaced apart to provide room for the face of the sliding ram to move toward the folding channel. This structure is suitable for the packaging of particularly thin articles, for example sheaths of cardboard or flattened folding boxes.

For a better understanding of the present invention, together with other and further objects thereof, reference is had to the following description taken in connection with the accompanying drawings, and its scope will be pointed out in the appended claims.

Figure 1:
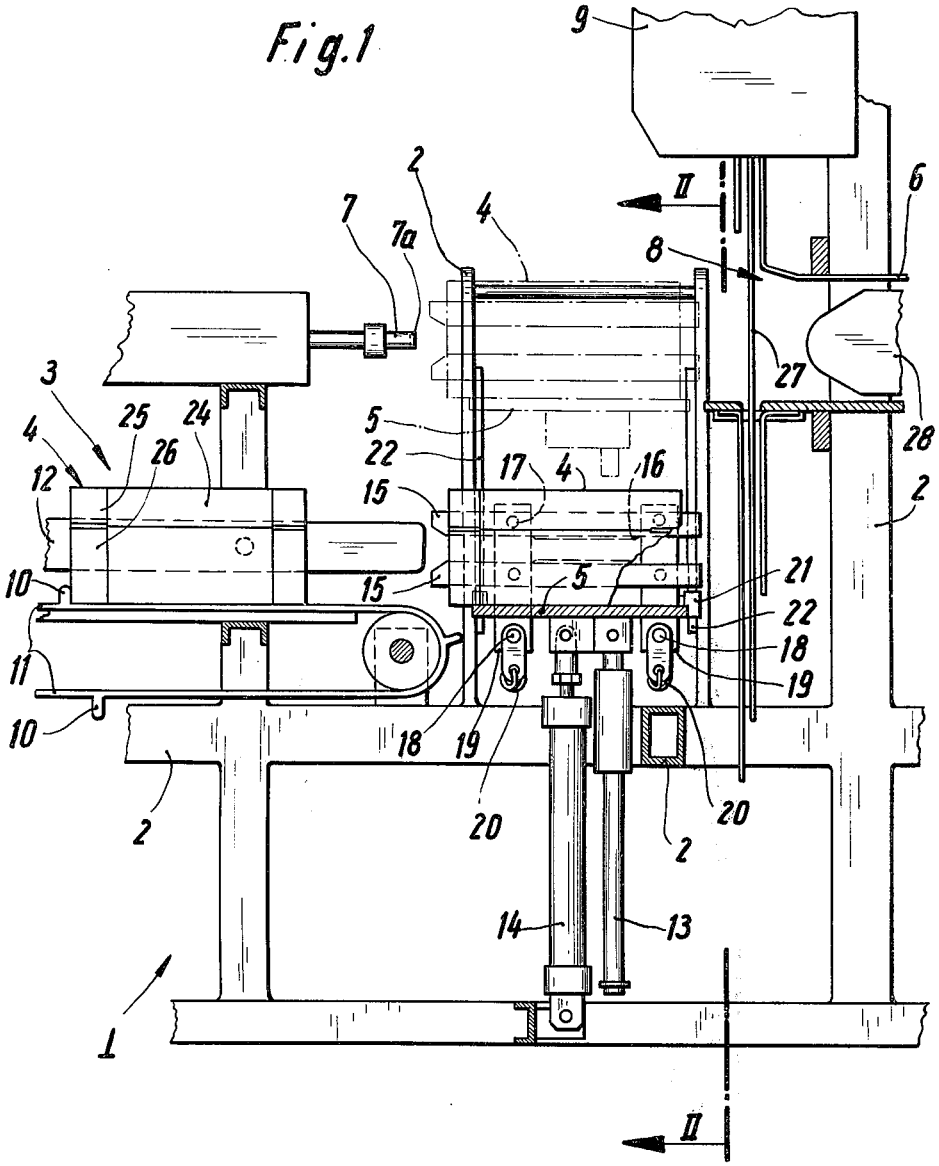
FIG. 1 is a longitudinal section through the relevant portion of a wrapping machine embodying the invention.

A machine embodying the invention, as illustrated in FIG. 1, includes a main frame 2 supporting the folding channel 6 and a feed mechanism 3 which delivers the articles 4 to the entrance end of the folding channel 6. A vertically movable lifting table 5, which is an extension of the feed mechanism 3, receives the articles 4 on a lower level and elevates them to the level of the folding channel 6. In so doing, the lifting table interposes the articles between the entrance of folding channel 6 and a sliding ram element 7 that is adapted to move over the lifting table and into the folding channel. A packaging-material feed mechanism 9 is arranged in front of the entrance 8 of the folding channel.

The feed or delivery mechanism 3 may conveniently comprise a conveyor belt 11 equipped with carrier elements 10 and guide bars 12 running adjacent to the conveyor path. The longitudinal section of FIG. 1 illustrates only the guide bar 12 which is to the rear. Conveyor belt 11 may move in continuous fashion to deliver objects 4 to the lifting table 5. In the illustrated embodiment, the objects are in the form of thin stacked prefabricated folding boxes which are positioned adjacent to one another and on end. Lifting table 5 is elevated or lowered by an operating cylinder 14 along vertical guide rods 13.

Figure 2:
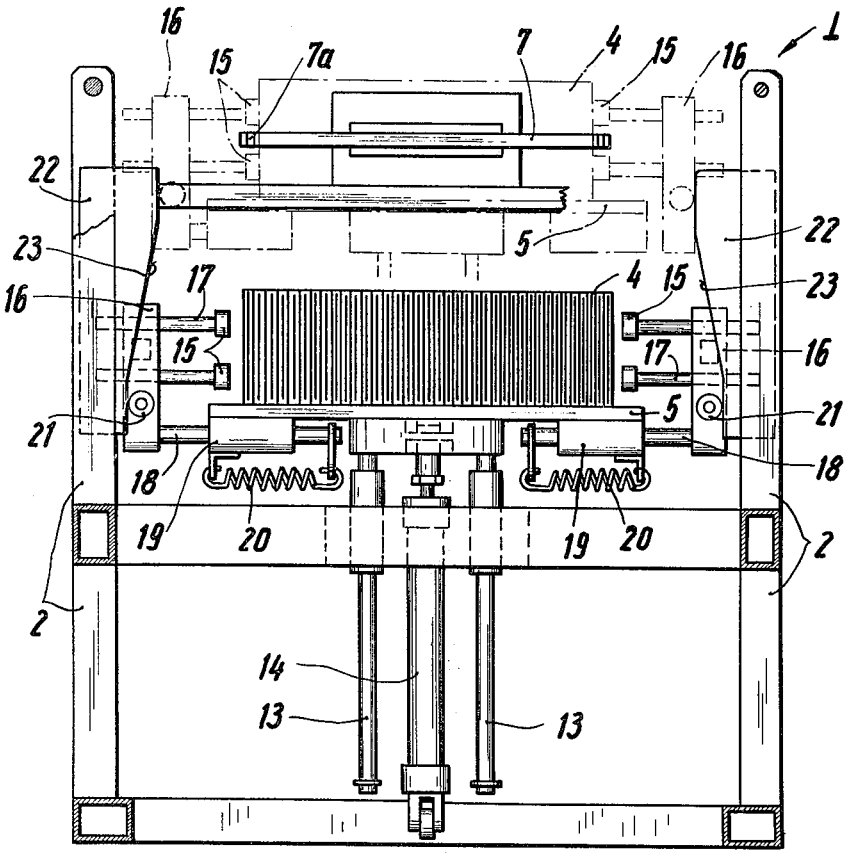
FIG. 2 is a transverse cross-section taken along the line II—II of FIG. 1.

Pressure plates 15 are arranged on each side of the lifting table and adapted for movement at right angles to the direction of feed of the feed mechanism 3. As shown in FIGS. 1 and 2, the pressure plates 15 preferably consist of several elements arranged in pairs, each being held by support rods 17. The support rods are securely affixed to carriers 16, and are spaced sufficiently far apart to allow the ends 7A of slide ram 7 to move between them. Each carrier 16 is mounted securely to a pair of horizontally positioned guide rods 18 which move longitudinally in bearings 19 which are attached to the lifting table. Springs 20 are engaged with both the lifting table 5 and the ends of guide rods 18 in order to bias the pressure elements away from the center of the machine.

Figure 3:
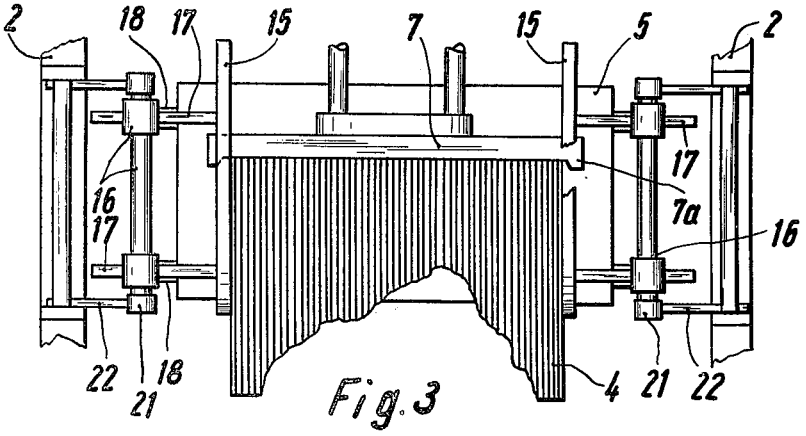
FIG. 3 is a partial plan view of the machine illustrated in the preceding figures.

As seen most clearly in FIGS. 2 and 3, cam followers or rollers 21 are rotatably mounted on the carriers 16. Guide rails 22 are positioned in pairs opposite one another in the path of travel of the lifting table, these rails being aligned with the cam followers 21 and running in vertical planes. The guide rails are provided with camming control surfaces 23 which are spaced wider at the bottom of lifting table travel than at the top. In consequence, as the lifting table is elevated the cam followers 21 are forced inwardly by cam surfaces 23 and force the pressure plates 15 into contact with the articles to be packaged.

Although not illustrated in the drawings, the guide ram 7 may conventionally be driven by an operating cylinder and activated after the lifting table has properly interposed the stacked articles 4 between it and the entrance 8 of folding channel 6.

A typical machine operating cycle begins with the lifting table 5 in the lowered position. The resiliently flexible articles 4 are placed upon the lifting table due to the action of the conveyor belt 11 and projections 10 thereon. It is contemplated that the articles are to be enclosed in a single sheath of predetermined width. The articles 4 may be, for example prefabricated packaging cartons consisting of tubes 24 folded flat, with the folding closure flaps hinged to the ends thereof. It is known that such folding flaps have a tendency to spring out.

After positioning of the articles on the lifting table 5, the table is elevated to the level of the folding channel 6. This causes the cam follower rollers 21, under the effect of camming surfaces 23, to move together bringing with them the pressure plates 15 against the action of springs 20. While the articles 4 may originally be arranged more or less loosely side-by-side, they are pressed together into a block of preselected width as determined by the spacing between the camming surfaces 23 on opposite sides of the machine. When the lifting table reaches its upper position, slide ram 7 is moved forward between pressure plates 15 pushing the compressed set of objects 14 toward the folding channel. Prior to movement of the objects, a packaging-material blank 27 is interposed between the lifting table and the folding channel and consequently the movement of the articles into the folding channel effects a wrapping of the packaging-material blank about the sides of the articles. Further wrapping is accomplished in the manner conventional with this type of equipment.

As soon as the ram has deposited the articles within folding channel 6, the lifting table 5 may be lowered to receive a fresh supply of articles. As it is lowered, cam followers 21 are forced into continuous contact with cam surfaces 23, under the action of springs 20. Accordingly, the pressure plates 15 retract towards the sides of the machine in order to provide an enlarged area for the deposit of the new and uncompressed group of articles to be wrapped.

While there have been described what is at present considered to be a preferred embodiment of this invention, it will be obvious to those skilled in the art that various changes and modifications may be made therein without departing from the invention and it is aimed, therefore, in the appended claims to cover all such changes and modifications as fall within the true spirit and scope of the invention.

What is claimed is:

1. A machine for wrapping a plurality of articles in a single package, comprising a lifting table for delivering a plurality of articles to a particular level, compressing means coupled to said lifting table and operative to move horizontally as a function of the vertical position of said lifting table whereby said articles are compressed, and wrapping means for horizontally receiving and wrapping said articles after delivery to said particular level.

2. A machine as defined in claim 1, wherein said compressing means are in part mounted on said lifting table, and are mechanically coupled to move horizontally in response to vertical movement of said lifting table.

3. A machine as defined in claim 1, wherein said compressing means comprise at least a pressure plate, a guide rail having a contoured surface mounted in a stationary position on said machine, and a roller mounted on said lifting table and engaged with said contoured surface to effect horizontal movement of said pressure plate in response to movement of said roller along said contoured surface.

4. A machine as defined in claim 3, comprising pressure plates on opposing sides of said lifting table, guide rails on opposing sides of said lifting table, and one of said rollers engaging the contoured surface of each of said guide rails, said guide rails and rollers being positioned to effect movement of said pressure plates toward each other.

5. A machine as defined in claim 4 wherein said wrapping means includes a folding channel and reciprocating feed means for pushing said articles from said lifting table into said folding channel, and said pressure plates comprise elements arranged in pairs on opposing sides of said lifting table, each pair being spaced apart to permit passage of said feed means therethrough.

6. A machine as defined in claim 4, including spring means for biasing said pressure plates away from each other.

7. A machine as defined in claim 5, including spring means for biasing said pressure plates away from each other.

8. A machine as defined in claim 2, wherein said compressing means comprises: cam means and cam follower means associated therewith.

* * * * *